US007299851B2

(12) United States Patent
Dekker

(10) Patent No.: US 7,299,851 B2
(45) Date of Patent: Nov. 27, 2007

(54) SAFETY CORD CONNECTOR

(75) Inventor: Nicolaas Dekker, Barendrecht (NL)

(73) Assignee: Hunter Douglas Industries BV, El Rotterdam (NL)

( * ) Notice: Subject to any disclaimer, the term of this patent is extended or adjusted under 35 U.S.C. 154(b) by 433 days.

(21) Appl. No.: 10/920,676

(22) Filed: Aug. 17, 2004

(65) Prior Publication Data

US 2005/0056385 A1 Mar. 17, 2005

(30) Foreign Application Priority Data

Sep. 11, 2003 (EP) ..... 03077868

(51) Int. Cl.
*E06B 9/38* (2006.01)

(52) U.S. Cl. ..... 160/178.1 R; 24/115 F; 24/132 R

(58) Field of Classification Search ..... 160/178.1 R, 160/173 R, 320, 177 R, 178.2; 24/115 R, 24/115 F, 132 R, 128; 16/442, 428
See application file for complete search history.

(56) References Cited

U.S. PATENT DOCUMENTS

| | | | | |
|---|---|---|---|---|
| 5,560,414 | A | 10/1996 | Judkins et al. | 160/178.1 |
| 5,562,140 | A | 10/1996 | Biba | 160/178.1 |
| 5,592,983 | A | 1/1997 | Sartini et al. | 160/178.1 |
| 5,735,329 | A * | 4/1998 | Akins et al. | 160/178.1 R |

FOREIGN PATENT DOCUMENTS

WO WO 99/37875 A 7/1999

* cited by examiner

*Primary Examiner*—James R. Brittain
(74) *Attorney, Agent, or Firm*—Dorsey & Whitney LLP

(57) ABSTRACT

A cord connector for use in a covering for an architectural opening, the connector being designed to interconnect a plurality of operating cords with a single pull cord and wherein the connector includes two interconnectable members that when interconnected define an interior space in which a retainer can be positioned. The retainer anchors the ends of the operating cords and is releasable from confinement by the two members when the two members are separated so that the operating cords can also be separated from the retainer.

18 Claims, 4 Drawing Sheets

SAFETY CORD CONNECTOR

CROSS REFERENCE TO RELATED APPLICATION

This application claims priority to European patent application No. 03077868.2, filed Sep. 11, 2003, which is hereby incorporated by reference as if fully disclosed herein.

BACKGROUND OF THE INVENTION

1. Field of the Invention

This invention relates to a device for connecting a plurality of operating cords of an architectural covering, such as a window covering, to a single pull cord. In particular, the invention relates to a connector for releasably holding operating cords, so as to safeguard children who might become entangled between the cords.

2. Description of the Relevant Art

Such cord connectors are described in U.S. Pat. Nos. 5,562,140, 5,592,983 and 5,560,414, each having two hingedly connected parts. A pull cord is connected to the bottom of each connector, and a plurality of operating cords are clamped between its closed, hingedly connected parts. If the head of a child becomes entangled between the operating cords, the outward directed force on the cords causes the parts to move apart and hingedly open. The cords are then no longer clamped between the two parts and are released, thereby releasing the child's head.

One drawback of such known cord connectors is that the operating cords have to be clamped sufficiently tightly between the two hingedly connected parts of each of them, so that the cords are not pulled out of the grip of the two parts when its blind is being operated normally by pulling on its pull cord. Such a minimum clamping force between the two hingedly connected parts must, however, be overcome to open the connector when a child is entangled in its cords. Unfortunately, this minimum clamping force is usually too great for the connector to be considered "child-safe". This is because the grip of the connector parts usually exceeds the maximum force which an entangled child would be likely to exert against the cords.

SUMMARY OF THE INVENTION

In order to overcome the disadvantages of such existing cord connectors and provide an alternative connector which is easier to assemble and less expensive, the invention provides a connector for releasably connecting the lower free ends of a plurality of vertically-extending operating cords of an architectural covering, wherein:

- the connector includes a pair of vertically-extending members and one or more connections between the members which can be connected and disconnected to respectively close and open the connector;
- the free end of each operating cord is connected to the connector and is removably attached to a retainer; and
- when the connections are connected and the connector is closed, the members form an interior space, between them, suitable for retaining therein the free ends of the operating cords and the retainer;
- whereby when at least one of the connections is disconnected, the connector is open, so that the retainer is released from the interior space and the free ends of the operating cords can become detached from the retainer.

Advantageously, the free ends of the operating cords are wound about the retainer when the retainer is in the interior space of the closed connector and are unwound from the retainer when the retainer is released from the interior space of the open connector. In this regard, it is especially advantageous that the walls of the interior space prevent the rotation of the retainer within the closed connector, and it is particularly advantageous that the retainer has the general form of an S with the free ends wound about its middle section, quite particularly between its top and bottom sections.

Also advantageously, a pull cord is attached to a bottom portion of one of the members, and one of the connections is a hinged connection between bottom portions of the members. Thereby when an other one of the connections is disconnected, the one member is moved, relative to the other member, about the hinged connection, to open the connector, so that the retainer is released from the interior space and can rotate and the free ends of the operating cords can then become detached from the retainer. In this regard, it is especially advantageous that the other one of the connections is between top portions of the members and there is an elongated slit in the top of one of the members, through which the free ends of the operating cords extend in a side-by-side relationship into the retainer, and it is particularly advantageous that the elongation of the opening and the side-by-side relationship extend in a direction perpendicular to the hinged connection. In this regard, it is particularly advantageous that the other one of the connections is a frictional connection between top portions of the members, quite particularly a locking groove on one member and a mating locking pin that is on the other member and is vertically aligned with the locking groove. It is also especially advantageous that, when the connector is closed, the retainer is within an inner one of the members that is within the other member.

BRIEF DESCRIPTION OF THE DRAWINGS

Further aspects of the invention will be apparent from the detailed description below of particular embodiments and the drawings thereof, in which.

DETAILED DESCRIPTION OF THE PREFERRED EMBODIMENTS

Figure 1:
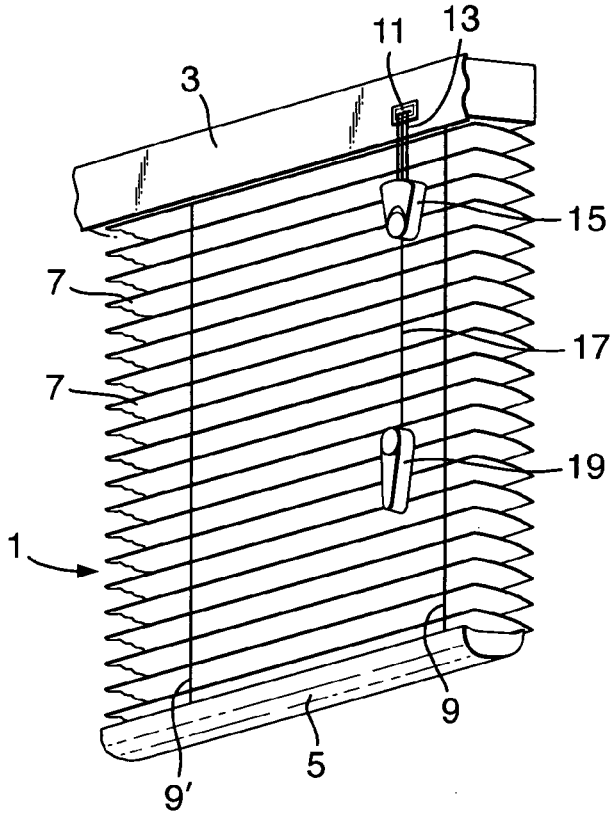
FIG. 1 is a front perspective view of a part of a window covering with the cord connector of the invention.

FIG. 1 shows the right side of a conventional horizontal venetian blind 1 with a longitudinally-extending head rail 3 and bottom rail 5. A plurality of a longitudinally-extending slats 7, between the head rail and bottom rail 3, 5, can be raised and lowered by means of a pair of conventional operating cords 9, 9' (shown in dotted lines in FIG. 1).

Ladder cords, which are usually provided in conventional horizontal venetian blinds, have not been shown in FIG. 1 for the sake of simplicity. From an opening 11 in the front of the head rail 3, a plurality of lift cords 13 extend downwardly to a cord connector 15 of the invention. A single pull cord 17 extends downwardly from the bottom of the cord connector 15, and a tassel 19 is connected to the bottom of the pull cord 17. When a user of the blind 1 moves the tassel 19 vertically, such movement is transmitted in a conventional manner to the pull cord 17, the connector 15, the lift cords 13 and the operating cords 9,9'.

The connector 15 releasably connects the lift cords 13 to the pull cord 17. Under normal operating conditions, the connector 15 securely holds the lift cords 13 together, so that a user can pull the pull cord 17 and tassel 19 vertically, particularly downwardly, without the lift cords becoming disconnected from the connector.

Figure 2:
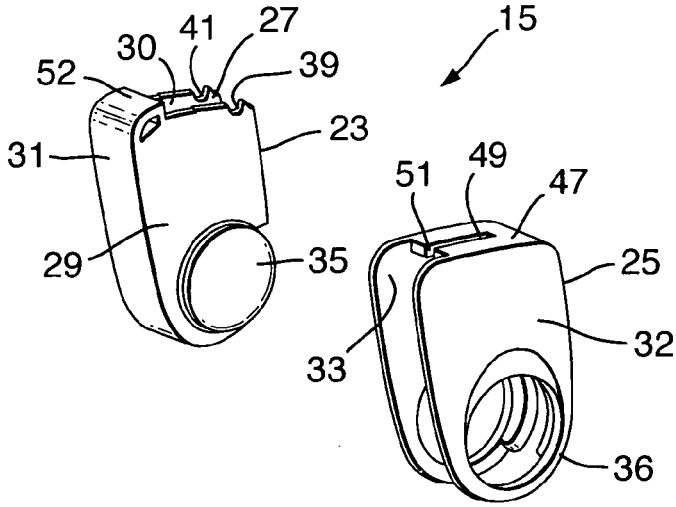
FIG. 2 is an exploded view of the two parts of the connector.
Figure 4:
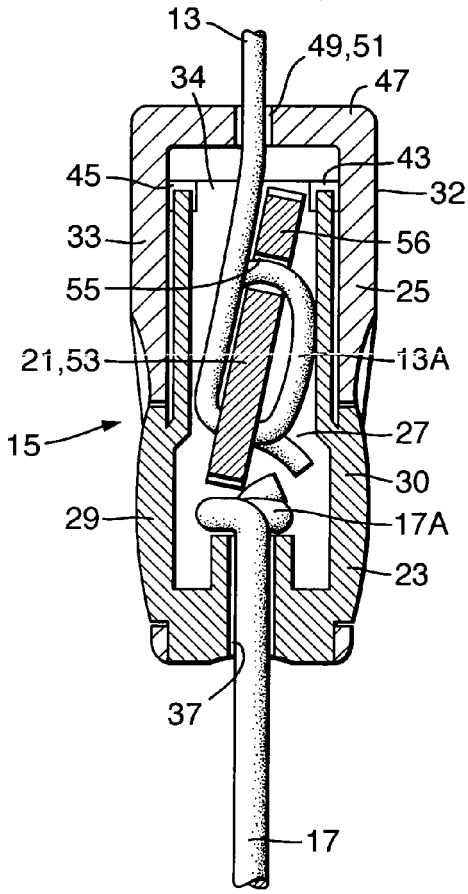
FIG. 4 is a cross-section of the connector in its closed position with its attached lift and operating cords and its cord retainer, about which its lift cords are wound within it.
Figure 5:
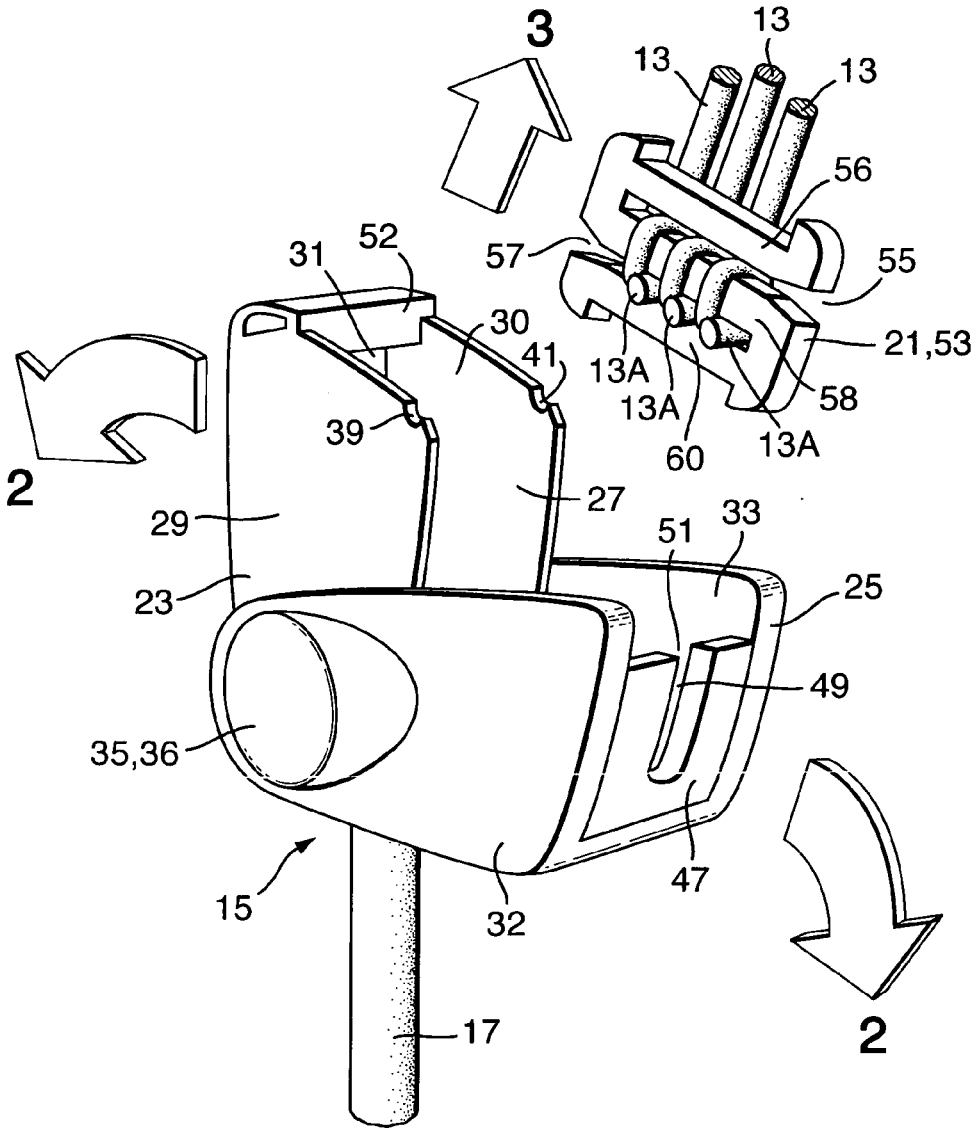
FIG. 5 is a front perspective view of the connector in its open position with its lift cords wound fully about its retainer but outside of the connector.
Figure 6:
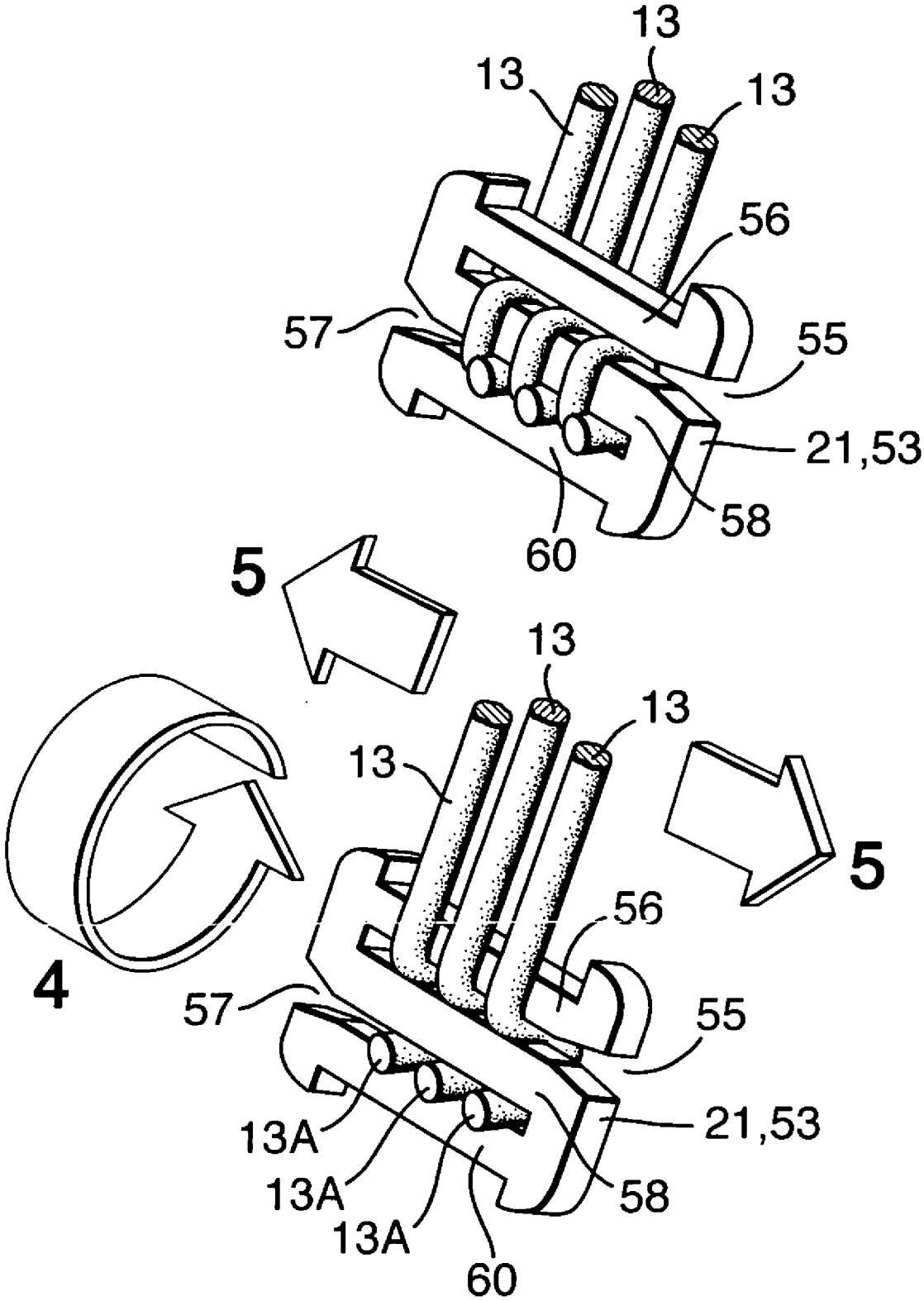
FIG. 6 are perspective views of the connector's retainer, showing the retainer with the lift cords wound fully about it as in FIG. 5 and with the lift cords partially unwound from it.

FIG. 2 shows the connector 15 without its cord retainer 21 that is shown in FIGS. 4-6. The connector 15 is preferably a box-like structure that has a vertically-extending left or inner member 23 and a vertically-extending right or outer member 25. When the inner member 23 is within the outer member 25, the members close the connector and its hollow interior 27, within the inner member 25, and can accommodate the retainer 21 with the lift cords 13 attached to it in the interior 27.

As seen from FIGS. 2-5, the inner member 23 has a pair of opposite, front and rear, interior walls 29, 30 which are connected by a left side wall 31, and the outer member 25 has a pair of opposite, front and rear, exterior walls 32, 33 which are connected by a right side wall 34. In the closed connector, its interior 27 is between the front and rear walls 29, 30 of the inner member and between the left side wall 31 of the inner member and the right side wall 34 of the outer member 25. Bottom portions of the members 23, 25 are preferably hingedly connected to each other by means of a pair of frontwardly- and rearwardly-extending pivots 35 that are on bottom portions of the front and rear, interior walls 29, 30 of the inner member 23 and that extend through frontwardly- and rearwardly-extending bores 36 in bottom portions of the front and rear, exterior walls 32,33 of the outer member 25. The inner member 23 can pivot about the hinged connection 35, 36, out of the outer member 25, to open the connector 15 when the lift cords 13 are pulled apart, for example by a child entangled in them, as described below.

As also seen from FIGS. 2-5, the upper free end of the operating cord 17 extends into the bottom of the inner member 23. In this regard, the bottom wall of the inner member 23 includes a vertical opening 37, through which the upper free end of the operating cord 17 is inserted. A knot 17A is provided in the upper free end of the operating cord 17 to prevent it from being separated from the inner member 23 and the connector 15 when the pull cord or the tassel 19 is pulled vertically, particularly downwardly.

Figure 3:
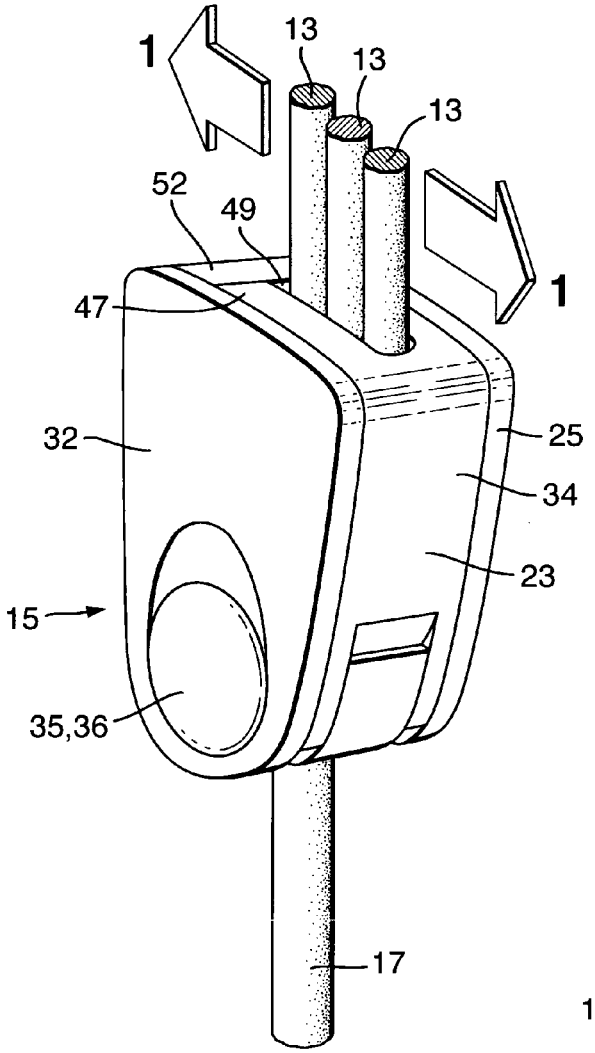
FIG. 3 a front perspective view of the connector in its closed position with lift cords and an operating cord attached to it.

As further seen from FIGS. 2-5, the inner and outer members 23, 25 of the connector 15 are frictionally connected to one another to keep the inner member within the outer member and thereby keep the connector closed under normal operating conditions of the blind 1. Preferably, the top of the front and rear, interior walls 29, 30 of the inner member 23 each include a locking indent or groove 39, 41, and the top portions of the interior sides of the front and rear, exterior walls 32,33 of the outer member 25 each include a mating locking pin or abutment 43,45 (shown only in FIG. 4). The locking pins 43,45 are vertically aligned with the locking grooves 39, 41, respectively. Preferably, the locking pins 43,45 extend towards each other from the interior sides of the front and rear, exterior walls 32,33, just below the top wall 47 of the outer member. As a result, the locking pins 43,45 nest in the locking grooves 39, 41 and are frictionally held there, under normal operating conditions of the blind 1 and its pull cord 17 and tassel 19, when the inner member 23 is within the outer member 25 and the connector is closed as shown in FIGS. 1, 3 and 4

As still further seen from FIGS. 2-5, the top wall 47 of the outer member 25 includes an elongated slit 49, the length of which is perpendicular to the pivotal connection 35, 36 of the connector members 23,25 and parallel to the front and rear, exterior walls 32,33. The slit 49 is only wide enough to accommodate the free ends of the lift cords 13 in side-by-side relationship as the lift cords extend downwardly through the slit 49 into the closed connector. The left lengthwise end 51 of the slit 49 extends to the left end of the top wall 47 and is open, so that the lift cords can move outwardly of the slit 49, through its open end 51, when the connector is open. The free ends of the lift cords 13, extending through the slit 49 into the interior 27 of the closed connector 15, are releasably attached to the retainer 21 within the connector's interior 27 under normal operating conditions of the blind 1 and its pull cord 17 and tassel 19. The top wall 52 of the inner member 23 abuts against the open end 51 of the slit 49 in the top wall 47 of the outer member when the connector is closed. Thereby, the top wall 52 of the inner member prevents the lift cords 13 from moving lengthwise out of the slit 49, through its open end 51, when the connector is closed.

As seen from FIGS. 4-6, the retainer 21 is a generally rectangular, rigid web 53 with a pair of lengthwise parallel slits 55 and 57. The retainer is preferably provided within the interior 27 of the closed connector 15 with its web 53 extending generally vertically and one of its slits 55 above its other slit 57. The slits 55, 57 are open only on opposite widthwise sides of the web 53, whereby the retainer has a generally S-shape with a middle section 58 between the slits and top and bottom sections 56, 60 above and below the slits. The end portion 13A of the free end of each lift cord 13 can be threaded through the web 53: initially through its lower slit 57, then around its middle section 58 and through its upper slit 59, and then again around its middle section 58 and through its lower slit (as shown in FIG. 5). Preferably, the end portion 13A of the free end of each lift cord is threaded through the web 53: initially through its upper slit 59, then around its middle section 58 and through its lower slit 57, and then the web is rotated transversely of its middle section (as indicated by the arrow 4 in FIG. 6), so that its upper slit 59 is on top, thereby winding the end portion of the lift cord another half turn about its middle section 58. The retainer and the wound end portions 13A of the lift cord can then be placed in the hollow interior 27 of the open connector 15 (as shown in FIG. 5) and the lift cords 13 can be urged through the open end 51 of the slit 49, so that the lift cords extend upwardly through the slit in side-by-side relationship. Then, the connector can be closed by urging its inner member 23 to pivot about its pivotal connection 35, 36 and to move within its outer member 25 until the locking pins 43,45 nest in the locking grooves 39, 41, to frictionally hold the members together and hold the connector closed (as shown in FIGS. 3 and 4) under normal operating conditions. When closed, the front and rear wall 29, 30 of the connector's inner member abut against both the front and rear sides of the retainer 21 and prevent it from rotating within the interior 27, so that the lift cords 13 cannot unwind from the retainer.

In normal operation of the blind 1, the connector 15 remains closed with the locking pins 43,45 nesting in the locking grooves 39, 41, regardless of the downward force exerted on the pull cord 17 and tassel 19 by a user of the blind and on the bottom of the connector by the pull cord. Within the closed container, the free ends of the lift cords remain wound about the retainer 21.

However if an infant became entangled in the lift cords 13, the weight and force of the infant would urge the lift cords to move apart from their side-by-side relationship within the slit 49 in the top wall of the outer member 25 (as indicated by the arrows 1 in FIG. 3). As a result, some of the lift cords would move lengthwise within the top wall slit 49, towards its open end 51, and would abut against the top wall 52 of the inner member 23. This would cause the inner member 23 to begin to pivot about the pivotal connection 35, 36 away from the outer member 25, then cause the locking pins 43,45 to come out of the locking grooves 39, 41, and then cause the inner member to pivot out of the outer member, thereby opening the connector 15 (as indicated by the arrows 2 in FIG. 5). Then, all the lift cords 13 would move lengthwise within the top wall slit 49 and then out of its open end 51 and then out of the open connector. Then, the connector members 23, 25 would fall, along with the pull cord 17 and the tassel 19, away from the retainer 21 and the end portions 13A of the lift cords, which are wound about it (as indicated by the arrow 3 in FIG. 5). Then, the retainer would rotate transversely of its middle section 58 (as indicated by the arrow 4 in FIG. 6), thereby allowing the lift cords to unwind from the retainer and then to be pulled out of the retainer slits 55, 57 by the pull of the entangled infant (as indicated by the arrows 5 in FIG. 6). Thereby, the free ends of the lift cords would become separated from one another and the infant would be freed from the entanglement of the lift cords.

This invention is, of course, not limited to the above-described embodiments which may be modified without departing from the scope of the invention or sacrificing all of its advantages. In this regard, the terms in the foregoing description and the following claims, such as "left", "right", "longitudinally", "bottom", "top", "inner", "outer", "upper", "lower", "perpendicular", "parallel", "length", "width", "vertical", "horizontal", "upwardly" and "downwardly", have been used only as relative terms to describe the relationships of the various elements of the cord connector of the invention for window coverings. For example, the cord connector 15 could be used for a vertical venetian blind or a pleated blind, rather than a horizontal venetian blind 1. Also, the left member 23 could be an outer member with bores 36 and the right member 25 could be an inner member with pivots 35. Further, other frictional means, besides the engagement of the locking pins 43,45 and locking grooves 39, 41, can be used to hold the connector closed under normal operating conditions.

I claim:

1. A cord connector releasably connecting the free ends of a plurality of lift cords of a window covering to a single operating cord, each of the lift cords including a free end which is connected to the cord connector, a cord length that extends from the cord connector, the cord connector further including a first member and a second member that are vertical, separably interconnected, movable between an open condition and a closed condition, and define in the closed condition an interior space therebetween suitable for retaining free end portions of the lift cords; wherein the free ends of the lift cords are retained in the interior space of the closed cord connector by a retainer separate and distinct from said first and second members such that when the first or second member or both move to the open condition the retainer is released from the interior space and the free ends of the lift cords are released from the retainer.

2. The cord connector of claim 1 wherein the retainer is a generally rectangular web and the free ends of the lift cords are wound about the web with at least a single full winding.

3. The cord connector of claim 2 wherein the interior space defined between the first and second members is of a shape and dimension preventing the retainer from rotating about any axis that coincides with the web and thereby preventing the free ends of the lift cords from unwinding from the retainer.

4. The cord connector of claim 1 wherein the first member is box-shaped and the second member is shaped as a cover.

5. The cord connector of claim 1 wherein the first and second members are hinged to one another.

6. A cord connector for releasably connecting the free ends of a plurality of lift cords of a window covering to a single operating cord wherein the connector comprises:

an openable and closeable structure formed by a pair of vertically-extending members which are relatively movable between an open and closed condition and between which in the closed condition the structure forms an interior space;

a cord retainer which is enclosable in said interior space and onto which retainer separate and distinct from said pair of members the free ends of the lift cords can be removably attached; and wherein in the open condition of the members, the retainer with the free ends of the lift cords attached thereto can be separated and released from the structure and the free ends of the lift cords can become detached from the retainer.

7. The cord connector of claim 6 wherein the free ends of the lift cords are wound about the retainer when the retainer is in the interior space of the closed connector and are unwound from the retainer when the retainer is released from the interior space of the open connector.

8. The cord connector of claim 7 wherein the walls of the interior space prevent rotation of the retainer within the closed connector.

9. The cord connector of claim 8 wherein the retainer has the general form of an S with the free ends of the lift cords wound about a middle section of the retainer.

10. The cord connector of claim 9 wherein the free ends are wound between top and bottom sections of the retainer.

11. The cord connector of claim 6 wherein a pull cord is attached to a bottom portion of one of the members, and there is a releasable hinged connection between bottom portions of the members, whereby when the hinged connection is released, the one member is moved, relative to the other member, about the hinged connection, to open the connector, so that the retainer is released from the interior space and can rotate and the free ends of the lift cords can then become detached from the retainer.

12. The cord connector of claim 11 wherein there is a second connection between top portions of the members and there is an elongated slit in the top of one of the members, through which the free ends of the operating cords extend in a side-by-side relationship into the retainer.

13. The cord connector of claim 12 wherein the slit is elongated and the side-by-side relationship extends in a direction perpendicular to the hinged connection.

14. The cord connector of claim 13 wherein the second connection is a frictional connection between top portions of the members.

15. The cord connector of claim 14 wherein the frictional connection comprises a locking groove on one member and a mating locking pin that is on the other member and is vertically aligned with the locking groove.

16. The cord connector of claim 15 wherein the frictional connection comprises a pair of locking grooves on opposite sides of one member and a mating pair of locking pins that are on opposite sides of the other member and are each vertically aligned with one of the locking grooves.

17. The cord connector of claim 6 or 12 wherein, when the connector is closed, the retainer is within an inner one of the members that is within the other member.

18. The cord connector of claim 11 wherein when the connector is closed, the retainer is within an inner one of the members that is within the other member.

* * * * *

UNITED STATES PATENT AND TRADEMARK OFFICE

CERTIFICATE OF CORRECTION

PATENT NO. : 7,299,851 B2
APPLICATION NO. : 10/920676
DATED : November 27, 2007
INVENTOR(S) : Nicolaas Dekker It is certified that error appears in the above-identified patent and that said Letters Patent is hereby corrected as shown below:

Col. 6

Claim 6, line 26, after "retainer", first occurrence, insert --separate and distinct from said pair of members--; and lines 27 and 28, after "retainer" second occurrence, delete "separate and distinct from said pair of members".

Signed and Sealed this

First Day of April, 2008

JON W. DUDAS
*Director of the United States Patent and Trademark Office*